US008317089B2

(12) United States Patent
Brexel et al.

(10) Patent No.: US 8,317,089 B2
(45) Date of Patent: Nov. 27, 2012

(54) MANIPULATION DETECTION SYSTEM FOR REMOVABLE MONEY CASSETTES FOR USE IN AUTOMATED TELLER MACHINES

(75) Inventors: Dirk Brexel, Geseke (DE); Oliver Dietz, Borchen (DE); Rainer Krietenstein, Paderborn-Sande (DE); Dirk Langhuber, Paderborn (DE)

(73) Assignee: Wincor Nixdorf International GmbH (DE)

( * ) Notice: Subject to any disclaimer, the term of this patent is extended or adjusted under 35 U.S.C. 154(b) by 613 days.

(21) Appl. No.: 12/607,803

(22) Filed: Oct. 28, 2009

(65) Prior Publication Data

US 2010/0117844 A1 May 13, 2010

Related U.S. Application Data

(63) Continuation of application No. PCT/EP2009/003991, filed on Jun. 4, 2009.

(30) Foreign Application Priority Data

Jun. 7, 2008 (DE) ..... 10 2008 027 348

(51) Int. Cl.
*G07F 19/00* (2006.01)

(52) U.S. Cl. ..... 235/379; 235/375; 235/380

(58) Field of Classification Search ..... 235/375, 235/379, 380

See application file for complete search history.

(56) References Cited

U.S. PATENT DOCUMENTS

| | | | | |
|---|---|---|---|---|
| 4,670,643 | A * | 6/1987 | Hain et al. | 235/379 |
| 6,014,649 | A | 1/2000 | Kobayashi et al. | |
| 6,191,690 | B1 * | 2/2001 | Mukogawa | 340/568.7 |
| 6,601,687 | B1 * | 8/2003 | Jenrick et al. | 194/206 |
| 6,845,905 | B2 * | 1/2005 | Blad et al. | 235/375 |
| 6,895,873 | B1 * | 5/2005 | Searle | 109/25 |
| 7,230,223 | B2 * | 6/2007 | Jespersen et al. | 250/206.1 |
| 7,341,179 | B2 * | 3/2008 | Tocher et al. | 235/379 |
| 7,428,873 | B1 * | 9/2008 | Searle et al. | 109/24 |
| 2003/0071048 | A1 * | 4/2003 | Black et al. | 221/2 |
| 2004/0173672 | A1 * | 9/2004 | Washington et al. | 235/379 |
| 2004/0188920 | A1 * | 9/2004 | Washington et al. | 271/145 |
| 2005/0077347 | A1 * | 4/2005 | Uematsu et al. | 235/379 |
| 2006/0028341 | A1 * | 2/2006 | Bartholf et al. | 340/570 |
| 2007/0013124 | A1 * | 1/2007 | Graef et al. | 271/145 |
| 2008/0084303 | A1 * | 4/2008 | Herd et al. | 340/568.1 |
| 2008/0136636 | A1 * | 6/2008 | Forrest et al. | 340/572.1 |

FOREIGN PATENT DOCUMENTS

| | | | |
|---|---|---|---|
| CH | 680171 | A5 | 6/1992 |
| DE | 690 04 906 | T2 | 7/1994 |
| DE | 198 39 977 | A1 | 3/2000 |
| EP | 0 418 098 | A1 | 3/1991 |
| EP | 1 530 170 | A1 | 5/2005 |
| GB | 2 280 056 | A | 1/1995 |

* cited by examiner

*Primary Examiner* — Daniel Hess
*Assistant Examiner* — Paultep Savusdiphol
(74) *Attorney, Agent, or Firm* — Harness, Dickey & Pierce, P.L.C.

(57) ABSTRACT

A manipulation detection system for removable money cassettes for use in automated teller machines is described that makes it possible to discriminate between unauthorized opening of the money cassette outside the automated teller machine and authorized opening of the money cassette inside the automated teller machine.

14 Claims, 4 Drawing Sheets

MANIPULATION DETECTION SYSTEM FOR REMOVABLE MONEY CASSETTES FOR USE IN AUTOMATED TELLER MACHINES

BACKGROUND OF THE INVENTION

1. Technical Field

The invention relates to a manipulation detection system for removable money cassettes for use in automated teller machines. Generic money cassettes have a lockable cash input/output slot for depositing money and/or dispensing money in the operating position in the automated teller machine.

2. Discussion

For security reasons, it is important to know whether the cash input/output slot of the money cassette was opened outside the automated teller machine in an unauthorized manner to remove banknotes. It is of particular interest whether a) the money cassette was opened in the period between being filled with banknotes at a bank or a valuables transportation company and its use in an automated teller machine, and b) whether the money cassette was opened in the period between its removal from an automated teller machine and being opened officially at a bank or a valuables transportation company.

For this reason, it is proposed in DE 690 04 906 T2 that, in order to detect manipulation, a notice of manipulation is generated at the automated teller machine by way of a sensor that detects the opening of the money cassette input/output slot.

In a system consisting of automated teller machine and money cassette, in which the cash input/output slot is opened automatically when said cassette is inserted into the automated teller machine before it reaches the operating position, due to the way the system operates, e.g. via a sliding block guide, this opening of the money slot is problematic to the extent that even this permitted opening erroneously results in a notice of manipulation at the cassette.

SUMMARY OF THE INVENTION

An object of the invention is, therefore, to develop a manipulation detection system that, in a simple and reliable manner, can distinguish between authorized opening of the cash input/output slot of a money cassette inside the automated teller machine and unauthorized opening outside the automated teller machine.

In accordance with an embodiment of the invention, the money cassette has a first switch that is actuated automatically when the money cassette is inserted into the automated teller machine, while the automated teller machine has a second switch that is similarly actuated automatically when the money cassette is inserted into the automated teller machine. Actuation of the two switches starts a timer in the money cassette and a timer in the automated teller machine respectively. The two timers are stopped automatically when the money cassette has reached its operating position. Using an evaluation and control device provided in the automated teller machine, the status of the timer in the money cassette is compared with the status of the timer in the automated teller machine. The notice of manipulation at the money cassette, which is always generated when the cash input/output slot in the automated teller machine is first opened, is canceled through an automated teller machine signal upon a positive result of the comparison.

Opening the input/output slot outside the automated teller machine always results in a notice of manipulation that cannot be reset any more (deleted), even when the money cassette is subsequently inserted into an automated teller machine since the timer status of money cassette and automated teller machine do not agree. The notice of manipulation can only be reset or deactivated by an authorized location, e.g. a bank or a special office at a valuables transportation company.

In accordance with an embodiment of the invention, an automated teller machine is understood to be any automat for the deposit or withdrawal of cash involving the use of money cassettes. Both self-service as well as staffed automats, e.g. the so-called automated cash desks fall under the rubric of automated teller machine. The generic automated teller machine can also be operated in a retail store, e.g. in conjunction with a pay station as a POS (point of sale) automat.

DESCRIPTION OF THE PREFERRED EMBODIMENTS

Figure 1A:
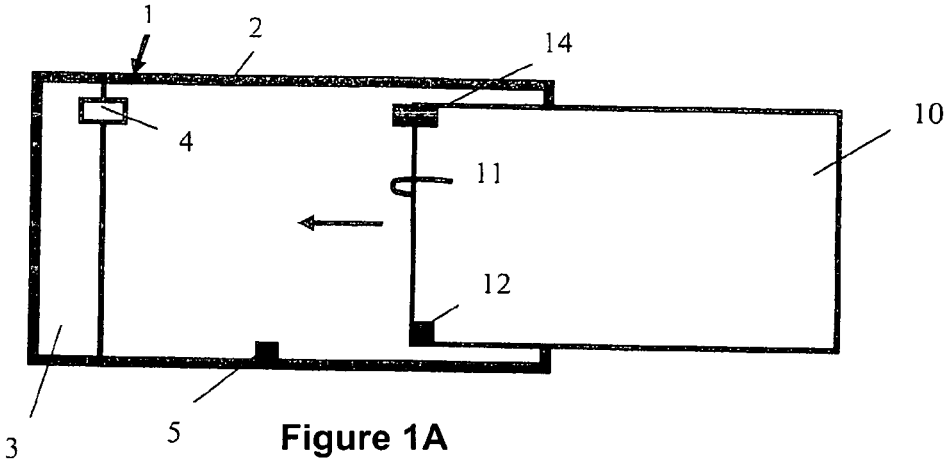
FIGS. 1A-1C show different phases when inserting a money cassette into an automated teller machine.
Figure 1B:
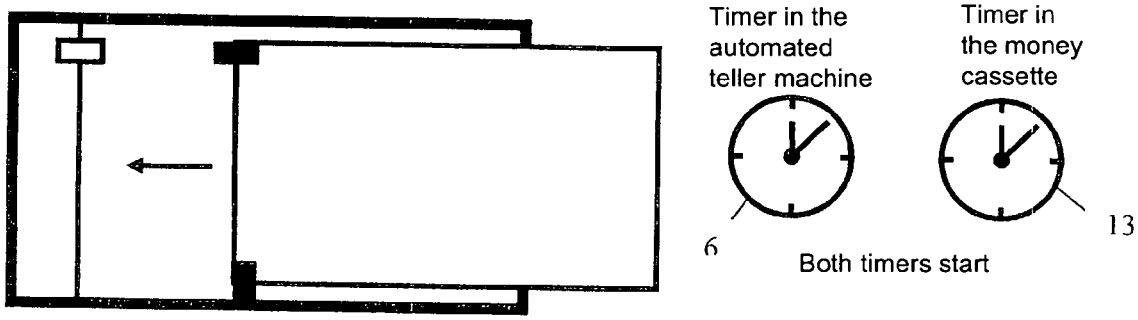
Figure 1C:
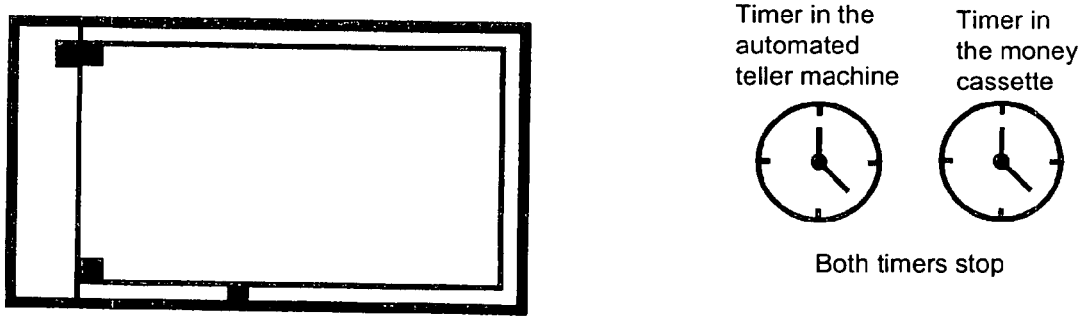

FIGS. 1A to 1C show schematically an automated teller machine with a money cassette (10) wherein different phases during insertion of the money cassette are represented. The cash input/output slot (11) is located substantially on the end face of the money cassette (10). A blind (screen) or a shutter, for example, is provided to close off this slot (11). In the process, the cash input/output slot (11) is already opened automatically by a sliding block guide (not shown) when the money cassette (10) is inserted into the automated teller machine (1) before it reaches the operating position. Insertion of the money cassette (10) is preferably accomplished by pushing the money cassette (10) into a rack (2) in the automated teller machine (1).

The money cassette (10) has a switch (12) that is actuated automatically when the money cassette (10) is inserted into the automated teller machine (1), at which point a timer (13) located in the money cassette (10) is started automatically by the actuation of said switch. The switch (12) is preferably a mechanical microswitch. However, other switch configurations are possible, for example a light curtain or a Hall sensor. The location at which the switch (12) is actuated along the path of the money cassette's insertion into the automated teller machine (1) is predetermined. Triggering the switch (12) is preferably effected by the opening of the cash input/output slot (11), which opening for its part is necessarily effected by the insertion of the money cassette (10) into the automated teller machine (1). In this way, the switch (12) can be used to generate a manipulation notice as well to actuate the timer (13). Regarding the manipulation notice, it can be an optical and/or acoustic signal that is generated by an alarm device and/or an entry in a manipulation storage device (16).

In an embodiment not shown, a separate sensor that is independent of the switch for starting the timer (13) is provided to generate a manipulation notice when the input/output slot (11) is opened. In this case, the rack (2) of the automated teller machine (1) into which the money cassette (10)

is inserted (pushed) has a corresponding mechanism to actuate the switch (12) at a specific insertion position.

As shown in FIGS. 1A to 1C, the automated teller machine similarly has a switch (5) that is similarly actuated as the money cassette (10) is inserted into the automated teller machine (1), thereby starting a timer (6) in the automated teller machine (1). This switch (5) is also preferably a mechanical microswitch. However, other switch configurations are also possible.

Both switches (5, 12) in the embodiment shown in FIGS. 1A to 1C are located in such manner that they are actuated synchronously, or at least almost synchronously. The position in which the two switches (5, 12), and thus the two timers (5, 13) are actuated, is shown in FIG. 1B.

If the money cassette (10) has been fully inserted and is thus in the operating position (see FIG. 1C), the two timers (6, 13) are stopped automatically. In the operating position, a plug (4) in the automated teller machine (1) makes contact with a mating plug (14) in the money cassette (10) to provide power and/or to transmit data. Full contact of the two plugs (4, 14) is detected as a "money cassette in operating position" event and is used to stop the two timers (6, 13). Both the automated teller machine (1) and the money cassette (10) have a plug contact scanning unit (8, 15) for this purpose. However, provision is also made for only the automated teller machine (1) to have a plug contact scanning unit (8, 15), whereby the timer (13) in the money cassette (10) is stopped after it reaches the operating position, via a signal from the automated teller machine (1) that is sent by way of the existing plug contact (4, 14).

An evaluation and control device (7) is provided in the automated teller machine (1) that compares the timer status of the timer (13) in the money cassette (10) with the timer status of the timer (6) in the automated teller machine (1), whereby a manipulation notice at the money cassette (10) is canceled upon a positive result from the comparison via a signal from the automated teller machine (1). Provision is preferably made for the data from the timer (13) in the money cassette (13) to be sent over the existing plug contact (4, 14) to the evaluation and control unit (7) in the automated teller machine. The same applies to the signal that the automated teller machine (1) sends to the money cassette (10) to reset the manipulation notice.

The manipulation notice is canceled if the time period between the start of the timer (13) in the money cassette (10) and when this timer (13) stopped is equal to the time period between the start of the timer (6) in the automated teller machine (1) and when this timer (6) stopped, within a specified tolerance.

In one embodiment, provision is made for the money cassette (10) to transmit the time period between its timer (13) starting and stopping directly to the evaluation and control unit (7) in the money cassette for comparison. In an alternative embodiment, provision is made for the starting time point and the stopping time point of the timer (13) in the money cassette (10) to be transmitted separately to the evaluation and control unit (7) in the automated teller machine (1), where the corresponding time period between start and stop is calculated for the comparison. Alternatively, or in addition thereto, provision is made to compare the starting and stopping time points of the two timers (6, 13) directly with each other.

In the embodiment shown in FIGS. 2A to 2D, the two switches (5, 12) are located for structural reasons in such a way that they are actuated only with a specific time delay when the money cassette (10) is inserted. The place, or the time point, at which the switch (12) of the money cassette (10) is activated has been identified with the reference numeral 12A. Without additional measures, the time delay in this case would depend on the different speed at which the money cassette (10) is inserted into the automated teller machine (1), which depends on the operator and the situation. A reliable comparison of times could not be performed with a time delay that varies so widely. For this reason, a mechanical resistance to insertion is provided that has to be overcome temporally when the money cassette is inserted before both switches (5, 12) are actuated. This resistance to insertion is drawn in schematically in FIGS. 2A to 2D and identified with the reference numeral 9. The operator must apply a specific minimum force when inserting the money cassette to overcome the resistance to insertion (9), which force ensures that a maximum time is not exceeded after the resistance to insertion has been overcome to cover the subsequent distance over which both switches (5, 12) are actuated. In other words, overcoming the resistance to insertion (9) achieves sufficient impetus so that the time delay between the actuation of the two switches (5, 12) can be reduced to a calculable maximum quantity.

Figure 2A:
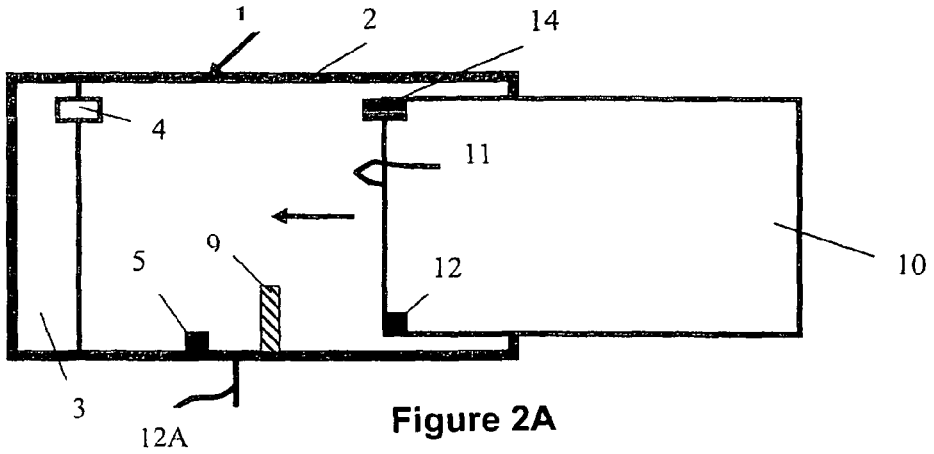
FIGS. 2A to 2D show different phases when inserting a money cassette into an automated teller machine.
Figure 2B:
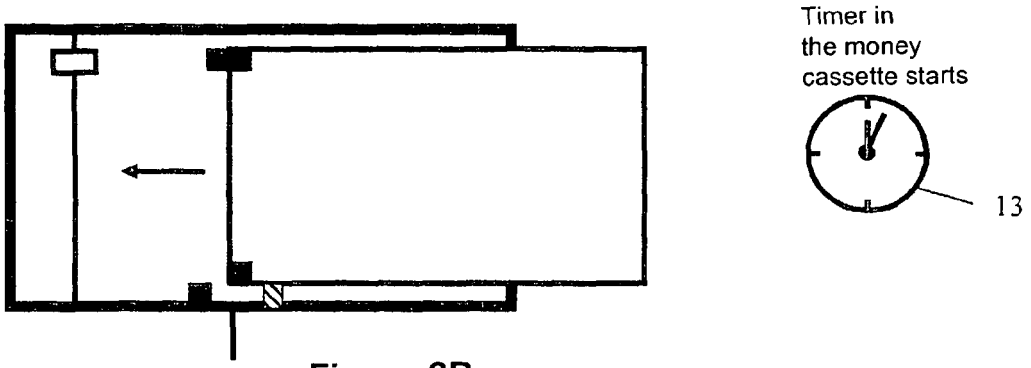
Figure 2C:
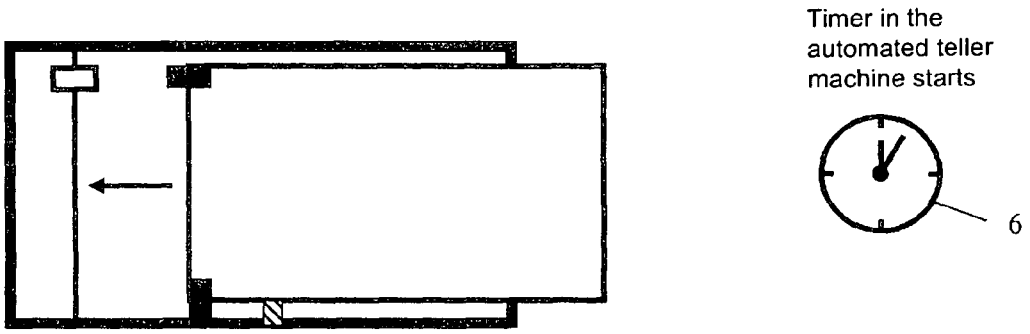
Figure 2D:
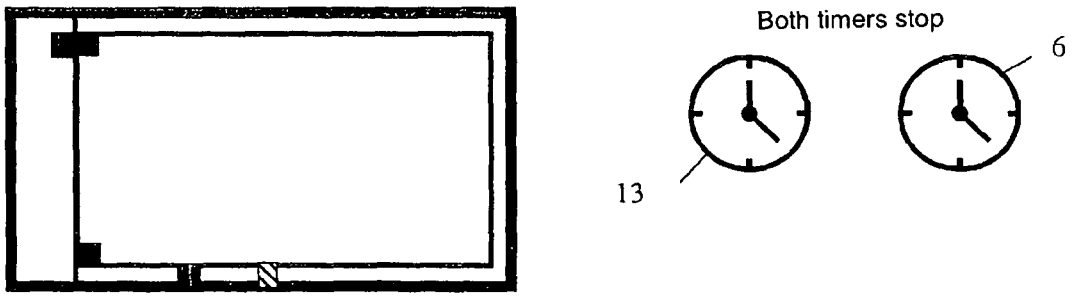

In FIG. 2B, a money cassette is located in a position in which the resistance to insertion (9) has been overcome and the switch (12) in the money cassette (10) is being actuated, resulting in the timer (13) in the money cassette (10) being started. In FIG. 2C, the money cassette (10) is in a position in which the switch (5) in the automated teller machine (1) is being actuated, which results in the timer (6) in the automated teller machine (1) being started. In FIG. 2D, the money cassette (10) has reached its operating position.

Figure 3:
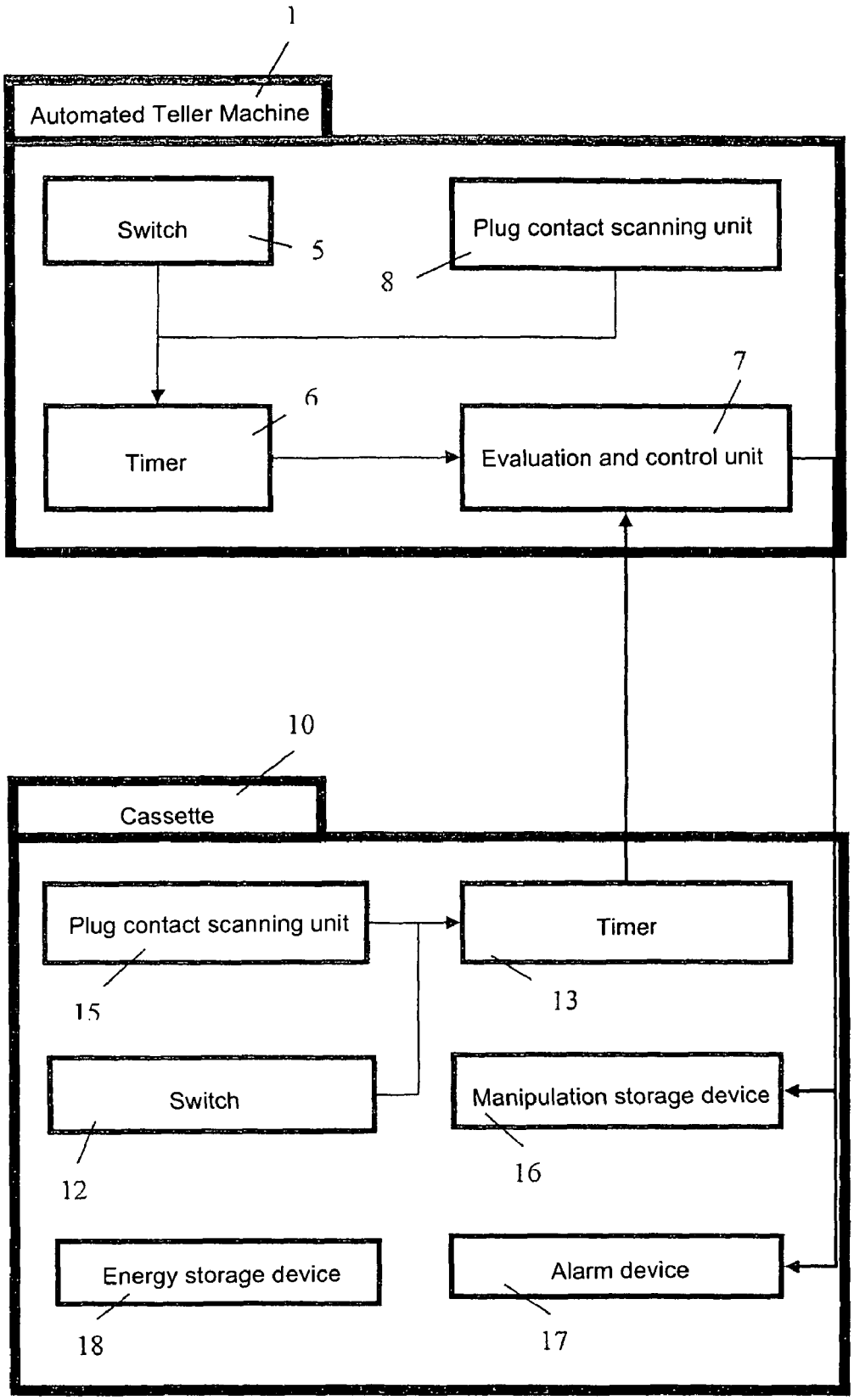
FIG. 3 shows a block diagram of an automated teller machine and a money cassette with the components essential to the invention.

FIG. 3 shows a block diagram of an automated teller machine (1) and a money cassette (10) with the respective components that have already been explained previously. As can be seen from FIG. 3, the money cassette (10) has a separate energy storage device/battery (18) to supply the components in the money cassette (10) with power. Power to the components in the money cassette (10) is preferably supplied over the existing plug contact through the automated teller machine (1) when said cassette is in the operating position.

Figure 4:
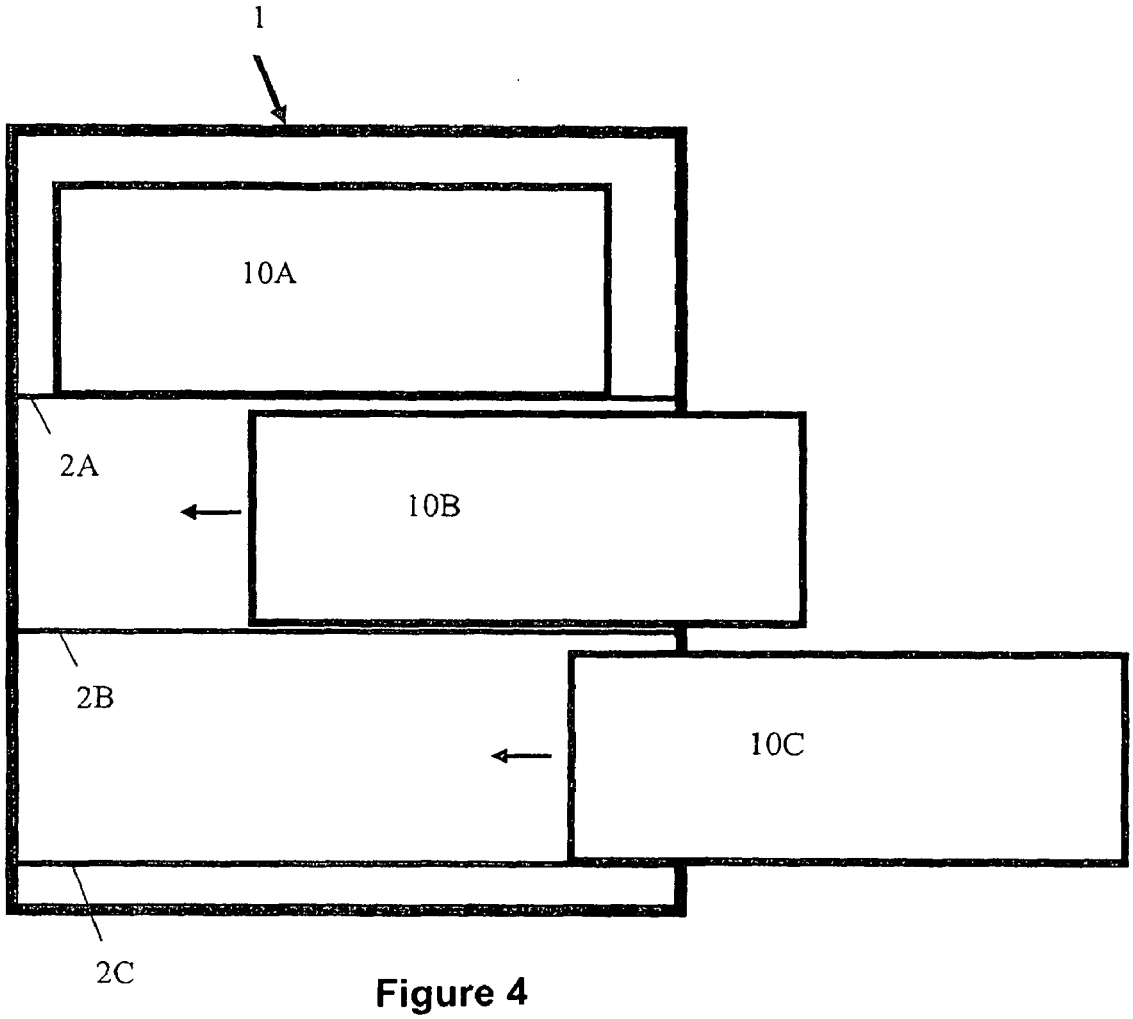
FIG. 4 shows a schematic drawing of an automated teller machine into which three money cassettes can be inserted, located one above the other.

Typically, an automated teller machine (1) has two or more racks (2A, 2B, 2C) to accommodate a money cassette (10A, 10B, 10C). FIG. 4 shows a schematic representation of an automated teller machine (1) into which three money cassettes (10A, 10B, 10C) can be inserted, located one above the other. A switch (not shown in FIG. 4) is assigned to each rack (2A, 2B, 2C) that is actuated automatically when a money cassette (10A, 10B, 10C) is inserted into the automated teller machine (1) to start a timer in the automated teller machine. An electrical plug (not shown in FIG. 4) is assigned in addition to each rack to make contact with an mating electrical plug on a money cassette in the operating position to stop a timer in the automated teller machine when the operating position is reached.

In one embodiment, a separate timer (not shown in FIG. 4) is provided in the automated teller machine for each rack (2A, 2B, 2C). In addition, a separate evaluation and control unit (not shown in FIG. 4) can be provided for each rack to perform the time comparison between the rack timer and the money cassette timer and, depending on said comparison, the feedback signal for the manipulation notice can be generated.

In an alternative embodiment, a central evaluation and control unit for all the timers assigned to the various racks (2A, 2B, 2C) as well as for all the timers of the money cassettes (10A, 10B, 10C) accommodated in the racks is provided in the automated teller machine (1).

Instead of using a separate timer for each rack (2A, 2B, 2C), provision is also made to use a central timer in the automated teller machine (1) with which a) the actuation of the various switches assigned to the racks is recorded as a start signal, b) attainment of the operating position of the money cassettes accommodated in the racks is recorded as a stop-signal.

What is claimed is:

1. A manipulation detection system for removable money cassettes used in automated teller machines, comprising:

the money cassette having a lockable cash input/output slot for the deposit and/or withdrawal of cash in the operating position in the automated teller machine, the cash input/output slot being opened automatically when the money cassette is inserted into the automated teller machine even before said cassette has reached its operating position, wherein a notice of manipulation is generated at the money cassette by way of a sensor when the input/output slot is opened, the money cassette having a first switch that is actuated automatically when the money cassette is inserted into the automated teller machine, the automated teller machine having a second switch that is similarly actuated automatically when the money cassette is inserted into the automated teller machine, wherein, when the two switches are actuated, a timer in the money cassette and a timer in the automated teller machine respectively are started, the two timers being stopped automatically when the money cassette has reached its operating position, an evaluation and control device in the automated teller machine that compares the timer status of the timer in the money cassette with the timer status of the timer in the automated teller machine, wherein the notice of manipulation at the money cassette is canceled by a signal from the automated teller machine upon a positive result of the comparison.

2. The manipulation detection system of claim 1, wherein the first switch, which is located in the money cassette and the second switch, which is located in the automatic banking machine, are actuated simultaneously when the money cassette is inserted.

3. The manipulation system from of claim 1, wherein the first switch, which is located in the money cassette, and the second switch, which is located in the automated teller machine, are actuated with a time delay when the money cassette is inserted.

4. The manipulation system of claim 3, wherein a resistance to insertion must be overcome when the money cassette is inserted before the two switches are actuated.

5. The manipulation system of claim 1, wherein the sensor that generates a manipulation notice at the money cassette when the cash input/output slot is opened is used as a switch to actuate the timer in the money cassette.

6. The manipulation detection system of claim 1, wherein the automated teller machine has an electrical plug to make contact with a mating electrical plug on the money cassette when in the operating position, wherein the two timers are stopped automatically when contact between the two plugs has been established.

7. The manipulation detection system of claim 1, wherein the manipulation notice is canceled if the time period between the start of the first timer and the stop of the first timer is the same as the time period between the start of the second timer and the stop of the second timer, within a specified tolerance.

8. The manipulation detection system of claim 1, wherein the manipulation notice is an optical and/or acoustic signal at the money cassette.

9. The manipulation detection system of claim 1, wherein the manipulation notice is an entry in a manipulation storage device in the money cassette.

10. The manipulation detection system of claim 1, wherein the automated teller machine has two or more racks to position a money cassette, where a switch is assigned to each rack that is actuated automatically when a money cassette is inserted into the automated teller machine in order to start a timer in the automated teller machine, where an electrical plug is assigned to each rack for completing contact with a mating electrical plug on a money cassette in the operating position in order to stop a timer in the automated teller machine when said cassette reaches the operating position.

11. The manipulation detection system of claim 10, wherein a separate timer is provided in the automated teller machine for each rack.

12. The manipulation detection system of claim 11, wherein a separate evaluation and control unit is provided in the automated teller machine for each rack which compares the status of the timer assigned to the rack with the status of the timer for the money cassette positioned in the rack, where the notice of manipulation at the money cassette is canceled through a signal from the money cassette in the event of a positive result from the comparison.

13. The manipulation detection system of claim 10, wherein a central evaluation and control unit is provided in the automated teller machine for all the timers assigned to the different racks and for all the timers for the money cassettes positioned in the racks.

14. The manipulation detection system of claim 10, wherein a central timer is provided in the automated teller machine with which a) actuation of the different switches assigned to the racks is recorded as a starting signal, b) attainment of the operating position of the money cassettes positioned in the racks is recorded as a stop signal.

* * * * *